United States Patent [19]

Williams

[11] 4,053,155

[45] Oct. 11, 1977

[54] MULTIPLE-GAME GAME BOARD WITH GOLF PUTTING SELECTING MEANS

[76] Inventor: Ralph S. Williams, 1355 Briarwood Road NE., Apt. N-5, Atlanta, Ga. 30319

[21] Appl. No.: 681,345

[22] Filed: Apr. 28, 1976

[51] Int. Cl.[2] ..... A63F 7/06

[52] U.S. Cl. ..... 273/87 C; 273/87 R; 273/119 R; 273/123 R; 273/127 R; 273/130 R; 273/131 AB; 273/131 C; 273/134 AD; 273/134 AG; 273/134 B; 273/134 CG; 273/180

[58] Field of Search ..... 273/87, 87.2, 87.4, 273/118–127, 130 R, 130 A, 130 AB, 130 AC, 130 G, 131 R, 131 A, 131 AD, 131 AC, 131 AB, 131 B, 131 BA, 131 BB, 131 C, 131 F, 131 L, 131 K, 131 KC, 131 KN, 131 KP; 273/134 R, 134 A, 134 AE, 134 AA, 134 AD, 134 AG, 134 AT, 134 B, 134 C, 134 CB, 134 D, 134 DB, 134 E, 134 ES, 134 G, 134 GM, 134 GA, 134 GB, 134 CA, 134 CG, 134 CH, 134 CF, 134 BD, 134 ER, 134 GP, 180

[56] References Cited

U.S. PATENT DOCUMENTS

| | | | |
|---|---|---|---|
| 672,771 | 4/1901 | Hoops, Jr. | 273/120 R |
| 1,127,861 | 2/1915 | Connor et al. | 273/87.4 |
| 1,403,345 | 1/1922 | Orr | 273/87 C |
| 1,546,837 | 7/1925 | Johnson | 273/134 CG |
| 3,352,558 | 11/1967 | Lucas | 273/87 R X |
| 3,434,720 | 3/1969 | Hall | 273/87 R X |
| 3,612,534 | 10/1971 | Browne | 273/134 CG |
| 3,658,339 | 4/1972 | Boileau | 273/134 CG |
| 3,884,469 | 5/1975 | Morton | 273/87.2 |
| 3,989,249 | 11/1976 | Breslow | 273/87 R |

*Primary Examiner*—Paul E. Shapiro
*Attorney, Agent, or Firm*—James B. Middleton

[57] ABSTRACT

A multiple-game game board having a plurality of locations, markers movable to each of the locations, progress in each game being indicated by advancing a marker through a plurality of locations, and selecting means for determining the next location to which a marker is to be moved, the selecting means including golf putting apparatus including a plurality of holes arranged so that a ball must fall into one of the holes, and programming means for selectively setting the value of each of the plurality of holes, the setting of the programming means being determined by the location of the markers on the game board.

7 Claims, 5 Drawing Figures

MULTIPLE-GAME GAME BOARD WITH GOLF PUTTING SELECTING MEANS

This invention relates generally to games and the like, and is more particularly concerned with a multiple-game game board having putting means as the primary selecting means for all games.

There have been numerous indoor games based on the game of golf, many of these games utilizing random selecting means such as dice, spinners or the like to determine the progress of the game. While such games may appeal to those who enjoy indoor board-type games, they do not require skillful handling of golf clubs, nor do they require the actual hitting of a golf ball, so they do not aid in a person's improving his game of golf. Other apparatus has been designed to allow a person to use an actual golf club and ball to practice putting indoors, but such apparatus has normally taken the form of a single hole or other target towards which one putts. While practicing with such an arrangement tends to improve one's putting skills, there is very little incentive for a person to continue practice for very long since it rapidly becomes simply routine practice. There have been some efforts to devise an indoor game in which one uses actual golf clubs, but the games devised have been so remote from actual conditions encountered on a golf course that experienced golfers obtain no benefit and the game becomes just another indoor game having little correlation to the playing of golf.

The present invention overcomes the above-mentioned and other difficulties with the prior art apparatus by providing a multiple-game game board having markers locatable on the game board to show progress of the game, and selecting means for determining position and/or quantity of the markers to be located on the game board. The selecting means includes a putting surface having a plurality of targets thereon, and a programming means for changing the value of each of the plurality of targets. In some games, the value of the target may be the same throughout the entire game, though in other games the value of the targets may be varied periodically throughout the progress of the game as a result of the progress of the game. It is contemplated that the target will be holes into which a golf ball can fall so, if the player putts a ball into a hole, then the value of the hole determines the location of a marker on the game board. Because of the plurality of targets and the ability to change the value of each of the targets, numerous games can be played using the same selecting means and, though each player is practicing his putting, a different game is involved to give the players incentive to putt well.

These and other features and advantages of the present invention will become apparent from consideration of the following specification when taken in conjunction with the accompanying drawings in which.

GENERAL DESCRIPTION

Figure 1:
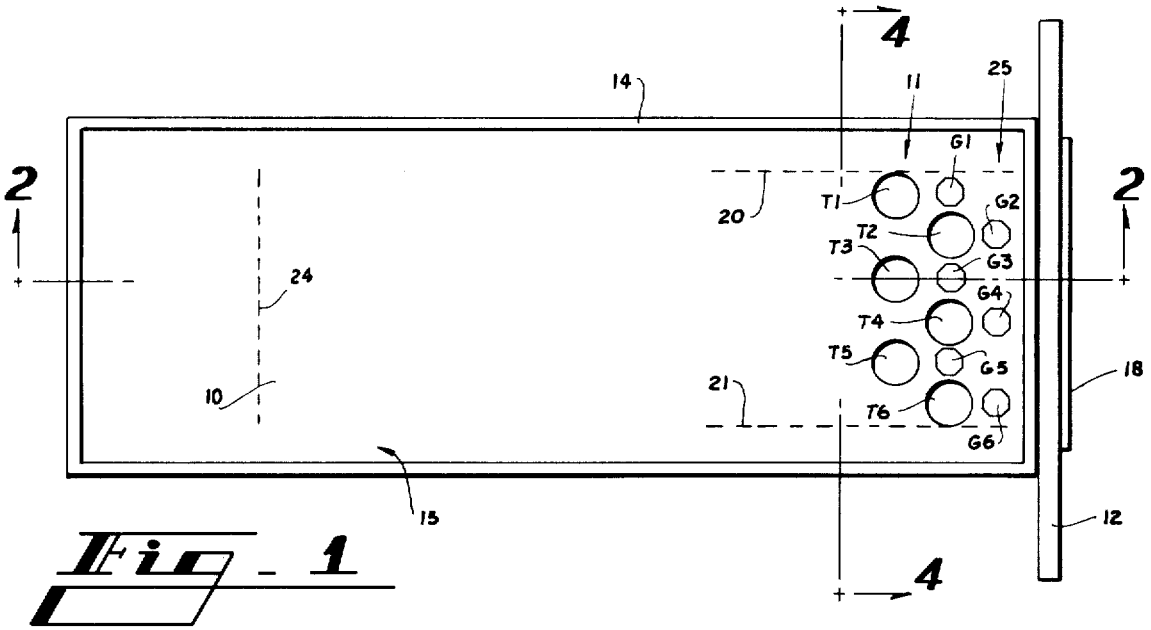
FIG. 1 is a top plan view of apparatus made in accordance with the present invention.

Referring now more particularly to the drawings, and to that embodiment of the invention here chosen by way of illustration, it will be seen in FIG. 1 that the apparatus includes a putting area generally designated at 10 and having a target 11 at one end thereof. A game board 12 is supported generally vertically at the extreme end of the putting area 10 as will be described in more detail hereinafter.

Figure 2:
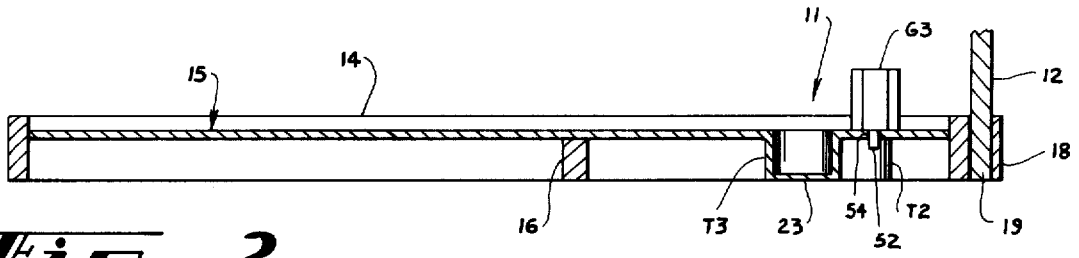
FIG. 2 is a cross-sectional view taken substantially along the line 2—2 in FIG. 1.

With particular attention to FIGS. 1 and 2 of the drawings, it will be seen that the putting area 10 is defined by a generally rectangular frame 14 which supports a playing surface 15 above the floor or other support surface. Additional structural members such as the member 16 shown in FIG. 2 of the drawings can be added as required for the needed strength in the playing surface 15. At the extreme end of the playing surface 15, it will be seen that there is a bracket 18 which is adapted to receive the lowermost end 19 of the game board 12 so that the game board 12 is held at the end of the playing surface for easy viewing by all of the players.

A target means 11 is placed between boundary lines 20 and 21 and includes a plurality of targets, here shown as six targets designated T1–T6. Looking at FIG. 2 of the drawings, it will be seen that each of the targets, for example target T3, is in the form of a cup, or hole, having its upper edges fixed to the playing surface 15 and having its bottom 23 sufficiently below the playing surface 15 to receive a golf ball therein.

From the foregoing it should now be understood that a player will stand on the playing surface 15 and place a golf ball on the putting area 10 behind the putting line 24. The player will then hit the ball with a golf club and attempt to cause the ball to fall into one of the targets T1–T6. It should be observed that the targets T1–T6 are arranged so that the boundary lines 20 and 21 are sufficiently close to the targets T1 and T6 respectively that a ball cannot roll between the boundary line 20 and the target T1 without falling into the target T1; similarly, the boundary line 21 is sufficiently close to the target T6 that a ball cannot roll between the boundary line 21 of the target T6 without falling into the target T6. It should further be observed that the targets T1, T3 and T5 are arranged on a straight line that is transverse to the putting area 10 and perpendicular to the boundary lines 20 and 21. The targets T2, T4 and T6 are similarly arranged on a straight line, the targets T2, T4 and T6 being placed rearwardly of the targets T1, T3 and T5. Each of the targets is located so that a line parallel to the boundary lines 20 and 21 cannot be drawn between two adjacent targets; that is to say, a ball cannot roll between any two of the adjacent targets without falling into one of the targets. Stated differently, it will be seen that the centerline of the targets which are parallel to the boundary lines 20 and 21 are spaced apart a distance less than the diameter of the holes; thus, the adjacent holes effectively overlap.

Rearwardly of the targets T1–T6, there is a programming means generally designated at 25 to indicate the value of each of the targets T1–T6. In FIG. 1 it will be seen that there is an individual programming device for each of the targets, the programming devices being designated as G1–G6 for targets T1–T6 respectively.

Figure 3:
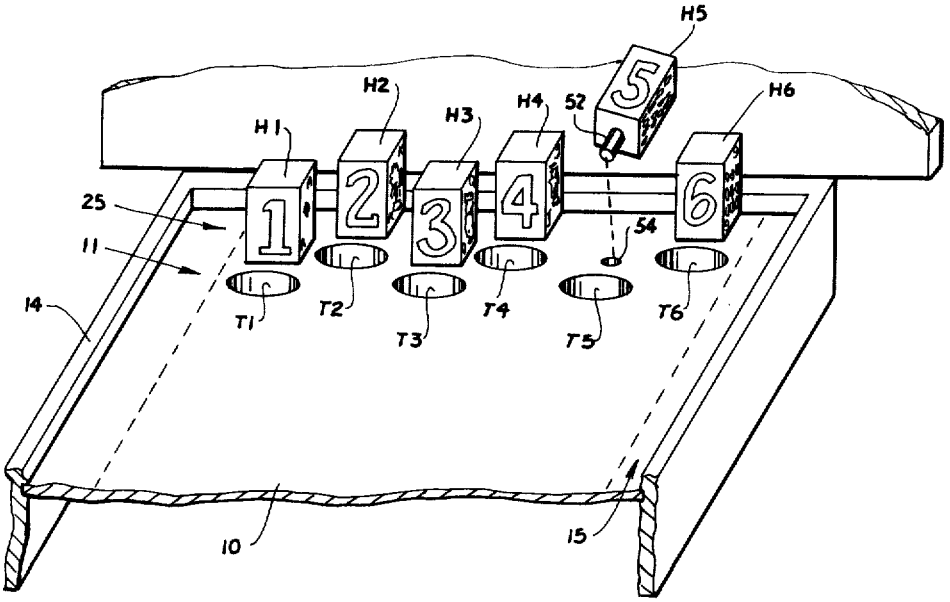
FIG. 3 is a partial perspective view showing a modified form of programming means, one of the programming means being exploded from its location to show the construction thereof.

Looking briefly at FIG. 3 of the drawings, it will be seen that a different form of programming device is shown. The programming devices G1–G6 are in the form of octagonal prisms whereas the programming devices shown in FIG. 4 and designated as H1–H6 are in the form of rectangular prisms. Those skilled in the art will understand that numerous forms of programming devices can be used to set the value of each of the holes, or targets, T1–T6 and the two forms of programming devices G1–G6 and H1–H6 are simply two particular embodiments of programming devices for use with the present invention.

Figure 4:
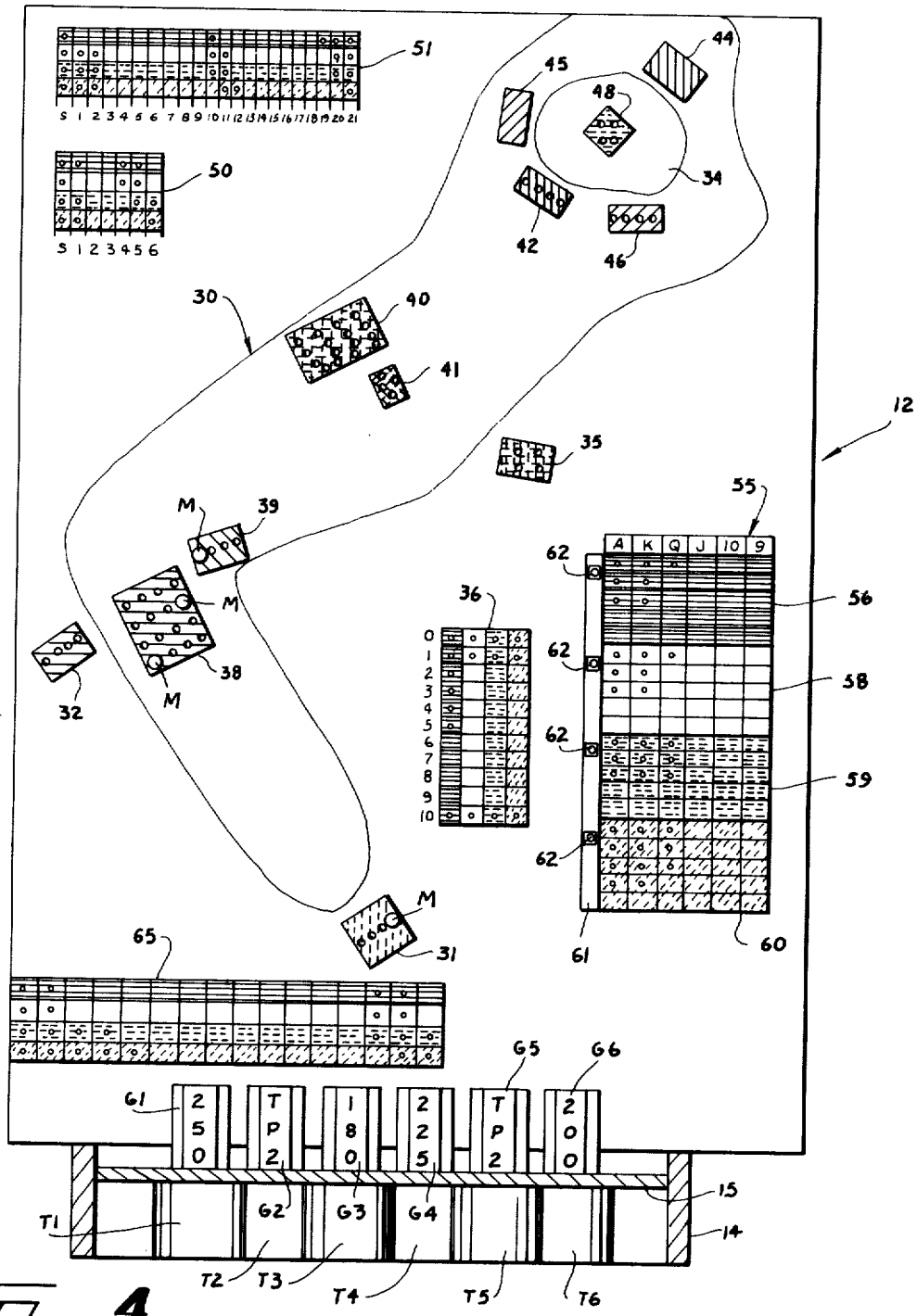
FIG. 4 is a cross-sectional view taken substantially along the line 4—4 in FIG. 1; and, FIG. 5 is a perspective view of a playing piece for use with the game board of the present invention.

Attention is next directed to FIG. 4 of the drawings which shows the face of the game board 12. It should be understood that the principle of the present invention includes the use of the putting area 10 with the targets T1–T6 as a selecting means to indicate value and/or position of a marker on the game board 12; and, it should be understood that the particular game, or the particular means for progressing through the game, is subject to considerable variance. By way of illustration, the embodiment of the invention here chosen by way of illustration includes five particular games, and each of these five games will be discussed in order to illustrate the apparatus.

THE GOLF GAME

The first game to be discussed will be a golf game, and it will be seen that the game board 12 includes a drawing of a golf fairway 30, the fairway 30 having a plurality of locations indicated thereon. At one end of the fairway 30, it will be seen that there is a first tee 31; further up a fairway 30, there is a second tee 32; and, closer to the green 34 there is a third tee 35. It should be observed that each of the tees 31, 32 and 35 is indicated as being a different color, and the reason for this will be discussed in detail hereinafter; also, it will be observed that there are other locations indicated on the fairway 30, other locations also being indicated as a specific color.

The game board 12 includes a scoring arrangement designated at 36 so players can keep up with their score during the course of a golf game. It should be observed that the score area 36 is divided into four different sections, the concept being that each player will utilize a different section to indicate his score.

At this point, it is felt that the best way to explain the apparatus and the means for playing the golf game in accordance with the present invention would be to discuss the procedure for playing the game of golf using the apparatus here shown.

The players would first decide which of the tees would be the starting point for the golf game. Since it will be seen that each of the tees 31, 32 and 35 is a different distance from the green 34, it will be understood that a selection of the tee will determine the length of time the game requires. For purposes of illustration, we shall assume that the four players select the first tee 31 to begin their game. Having thus selected the game of golf, and the tee 31, the players would be sure that the programming means G1–G6 are appropriately placed behind the targets T1–T6; then, the players would look at the first tee 31 and determine its color, and would set the programming devices G1–G6 so that a face of the programming devices having the same color as the tee 31 is facing the targets T1–T6. Through the device of matching colors, therefore, the value of each of the targets T1–T6 is determined. Now, in accordance with conventional rules of golf, the first player would step up to the putting line 24 and would attempt to sink his ball into one of the cups, or targets, T1–T6. It is contemplated that a code, or some indicia, will be placed on the faces of the programming devices G1–G6 so that a player will know the value of each of the targets T1–T6 and can attempt to play his best golf game by selecting a particular target. To increase the risk of a player's trying for the "best shot", it is contemplated that a bad shot will be placed adjacent to the good shot, for example, when long yardage is desired in view of the location on the golf fairway, the target having the value of the longest yardage may have adjacent thereto a value indicating that the player is in a trap. By thus weighting the desirable shots and the undesirable shots, one can very nearly simulate the hazards in playing an actual game of golf. Additionally, it should be observed that the fact that the programming devices G1–G6 are octagonal, there will be a diagonally disposed face at each side of the face indicating the value of the targets, and these diagonally placed faces are also admirably disposed to deflect a slightly off-center ball into an adjacent target.

Continuing with the game, each of the players would, in turn, stand on the putting surface and attempt to sink a ball into one of the targets T1–T6. In accordance with the value determined by the programming means 25, each player would place a marker M in the location 38, or perhaps in the location 39 which is a trap.

It should be observed that the location 38 is a different color from the first tee 31; therefore, when the players are ready to hit their balls again in rotation, the programming devices G1–G6 must be adjusted so that the face having the same color as the location 38 will be facing the targets T1–T6, thereby changing the value of each of the targets T1–T6. If one or more players is in the trap 39, when that player takes his turn, the programming devices G1–G6 should again be changed so that the face of the programming devices having a color matching the color of the trap 39 will be facing the targets T1–T6. As the players play from the location 38, the balls will "land" in the location 40, or perhaps in the location 41 which is a trap. As before, the programming devices G1–G6 will be appropriately oriented so that a face having a color matching the color of the location 40 or the location 41 will face the targets to set the appropriate value of each of the targets. Similarly, there are locations 42 and 44 which are locations on each side of the green 34; and, there are two additional traps 45 and 46 adjacent to the green; then, there is a location 48 which is on the green and would be a location from which the players make their final putts.

It should be realized that, in accordance with conventional rules of golf, in the event a player's ball goes beyond the boundary lines 20 or 21, a penalty can be imposed by increasing the number of strokes. In the event the frame 14 is immediately adjacent to the targets T1 and T6, a ball could not physically go outside of the boundary lines, but a penalty could similarly be imposed for striking the frame 14 which would be, in effect, the boundary.

Turning now to FIG. 4 of the drawings, it will be seen that the second tee 32 is the same color as the location 38 (here shown as blue). Since these two locations are close to each other, the effect of playing from these two locations would be very similar, and making the two locations the same color reduces the number of faces required for the programming devices G1–G6 and the number of different colors that must be utilized. It will of course be understood by those skilled in the art that additional programming devices, or a different form of programming device could be utilized, and each individual location could have a separate color requiring a separate value for the targets T1-T6.

THE GAME OF ROTATION

The next game to be discussed could be called "rotation" and it could be considered as similar in rules to the game of rotation played in pocket billiards. For this game, the programming devices illustrated in FIG. 3 of the drawings would be utilized, and the particular faces of the programming devices H1-H6 as shown in FIG. 3 of the drawings would be used for this game. It will be seen of course that the programming devices H1-H6 show simply numbers for each of the targets T1-T6 and the scoring space for the game of rotation is illustrated at 50 in FIG. 4 of the drawings. The fact that markers are placed in the scoring area 50 determines the disposition of the programming devices.

In the game of rotation, the first player would step on the playing surface 15 adjacent to the putting line 24 and would attempt to hit a ball down the putting area 10 and into the target T1 since the programming device H1 indicates that the target T1 is the first target. If the player succeeds in dropping his ball into the target T1, he would take another shot and attempt to place his ball in the target T2 as indicated by the programming device H2. The player would so continue as long as he succeeded in putting his ball into the appropriate target as indicated by the programming devices; however, when a player is unsuccessful in sinking his ball in the appropriate target, he must cease play and allow another player to begin. The next player would perform similarly until he was unsuccessful in sinking his ball into the appropriate next target. Continuing in this manner, the first player successfully to sink a ball into each of the six targets in the sequence designated by the programming devices H1-H6 would be the winner of the game. It will therefore be seen that a player would place a marker in a column of the scoring space 50, and would advance the marker in accordance with the value of the target he succeeded in hitting.

THE GAME OF BLACKJACK

The next game to be discussed also utilizes the programming devices H1-H6, and utilizes the scoring device 51 shown in FIG. 4 of the drawings. The game is comparable to the card game known as "blackjack" or "21"; however, instead of a player's receiving a plurality of cards in sequence from the top of a deck of cards, the player putts towards the targets T1-T6, and the programming devices H1-H6 indicate the card-value of each of the targets T1-T6. Thus, placement of markers in the scoring area 51 determines the disposition of the programming devices H1-H6.

As shown in FIG. 3 of the drawings, it will be seen that each of the programming devices H1-H6 includes a peg 52 centrally located on its bottom surface. The playing surface 15 includes a hole 54 adapted to receive the peg 52, there being a hole 54 adjacent to each of the targets T1-T6. Because of this arrangement, it will be seen that the programming devices H1-H6 can be located to dispose any one of the four faces towards the targets T1-T6 so that a player will see the appropriate face while he is putting.

Returning now to the game of blackjack, it will be understood that a face of the programming devices H1-H6 would have some indication of a playing card value thereon. By way of example, the card values may include Ace, Jack, Two, Four, Seven and Nine. With this arrangement, when a player would receive two cards in dealing blackjack, the player will step up to the putting line 24 and will putt two times. Since the player will see the programming devices H1-H6 and know the value of each of the targets T1-T6, the player can use his putting skill to get a good "hand" rather than depending purely on chance; however, if the golfer is not sufficiently expert, the "deal" becomes somewhat more speculative. After each of the players has his initial two cards, he will place the value of the two cards on the score board 51 by advancing a marker in the number that equals the card value. At this point, anyone who wishes to try for a better score (which is closer to a total of 21) he will putt once more and add the value of his third putt to his previous score and move his peg on the scoreboard 51 to indicate his new total. It will of course be understood, as in the card game of blackjack, if the total score is in excess of 21, the player loses, and the winner of the game is the highest score that does not exceed a score of 21. Also, as in the card game of blackjack, the game can be made more exciting by the players' placing bets so that the winner receives an amount of money, or a group of poker chips or the like.

THE GAME OF POKER

The next game to be discussed is a game of poker; and the programming devices H1-H6 are again used for the game of poker. Since poker is a different card game, in order to designate the particular face of the programming devices H1-H6 it is contemplated that the face of the programming devices H1-H6 that are to be used for blackjack can be one suit of the four card suits, for example Diamonds, while the face of the programming devices for use in the game of poker can be a different suit, such as Hearts. This will adequately separate the two faces of the programming devices without requiring a lengthy description or the like to be placed on the programming devices.

Looking now in more detail to the poker game to be played with the apparatus of the present invention, the area 55 of the game board 12 is used for the Poker game, and it will be seen that the area 55 is divided into four sub-areas designated 56, 58, 59 and 60. Each of these sub-areas is for use by one player. Also, along the left edge of the area 55 there is a strip 61.

Figure 5:
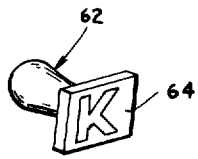

It is contemplated that a playing piece such as the piece shown in FIG. 5 will be removably attachable to the strip 61. Though numerous arrangements can be used for such removable attachment, one simple expedient is to make the strip 61 magnetic. The strip 61 could be a thin magnet in itself, or the strip 61 could be of a ferro-magnetic material with one or more magnets placed therealong. The piece shown in FIG. 5 could then have a small piece of soft iron or the like embedded therein, or could of course be made entirely of a magnetic material.

Across the top of the area 55, there is a list of card-values, and these would be the same as the values indicated on the programming devices H1-H6. The concept is that a marker would be placed on the board 12 in the location 55 to indicate the value received in putting.

Thus, assuming a group of players desires to play five card stud poker, each player would first draw a piece 62 from a group of pieces 62, preferably from a bottle or the like wherein the drawing would be completely by chance. Each player would then look at the base 64 of the piece 62 where a card-value is indicated. This piece 62 is the player's "hole card" for the poker game, and the piece 62 is placed on the strip 61 adjacent to that player's sub-area 56, 58, 59 or 60 with the base 64 against the strip 61 so other players will not know the values indicated on the piece 62.

After each player has his "hole card", the players begin to putt to make up the rest of their poker hand. As before, the programming devices H1–H6 will show the players the value of each of the targets T1–T6 and the player will try to make up his best poker hand.

As in the card game of poker, the players can place bets as they putt for new cards, and each can place a bet and remain in the game or refuse to bet and leave the game. The winner is the person who remains in the game and has the best "hand" in accordance with the rules of poker.

In the event the players wish to play seven-card poker, each player would draw two of the pieces 62 and place them on the strip 61, then putt for four cards, then draw a seventh one of the pieces 62.

THE GAME OF ANAGRAMS

The final game here shown is a game similar to anagrams wherein a player has a group of letters and he attempts to form a word. Once again the programming devices H1–H6 would be used, and the fourth face of the programming devices would be towards the targets T1–T6. The fourth face of the devices H would have a letter of the alphabet thereon, and the game would be scored in the area of the game board 12 designated at 65.

In playing the anagram game, the first player would putt as previously described. The value of the targets would be shown by the programming devices H1–H6, and the value of each would be a letter; therefore, the player would attempt to hit two targets that would provide letters to spell a two-letter word. If he succeeds in spelling a two-letter word he will advance his marker in the area 65. He may be allowed to continue to play, keeping the same two letters and attempting to add one letter to spell a three-letter word, though such a rule may be changed if desired to balance the game. When the player gets a letter and cannot spell the next word for which he is playing, another player begins. The players play thus in rotation until one of the players spells all words up to a six-letter word.

It will of course be realized that specific rules can be varied as to the number of times any one letter can be used by one player, and restrictions can be made on types of words that are acceptable. For example, as in the classical game of anagrams, one may not be allowed to use proper nouns, foreign-language words et cetera.

SUMMARY

From the foregoing discussion it will be seen that the present invention provides a putting apparatus that will assist a golfer in improving his golf game and can do much in teaching the game of golf to a novice. Though the playing surface 15 may be made in any size for which one has space, it is contemplated that the apparatus will be from about 4 feet (or 125 cm.) to about 12 feet (or 365 cm.). It is also contemplated that the targets T1–T6 will be holes somewhat smaller than the standard holes on a golf course. Thus, the standard golf course hole is 4 inches in diameter, so the targets T may be about 3 inches (or about 75 mm.).

While specific games have been illustrated in conjunction with the present invention it should be understood that the object of the invention is to provide a plurality of targets for putting, and some form of game wherein a player can progress through a plurality of locations on a game board in accordance with a value placed on the targets. Thus, the game board 12 could picture a race track, and the hazards could be pit stops, wrecks and the like; or, the game could be a big game hunt wherein the players approach the choice game (elephants, lions etc.); or, virtually any other game.

Further, while the markers are here shown as pags to be placed in an appropriate hole as the play progresses, it will be understood that any form of marker may be used, including a marker of the form of the piece 62 shown in FIG. 5 of the drawings. So, it will be understood by those skilled in the art that the embodiment of the invention here shown, and the particular games here discussed, are by way of illustration only and are meant to be in no way restrictive; therefore, numerous changes and modifications may be made, and the full use of equivalents resorted to without departing from the spirit or scope of the invention as defined by the appended claims.

I claim:

1. A game comprising a game board including a plurality of locations, at least one marker selectively movable to each of said plurality of locations, and selecting means for determining which of said plurality of locations said marker is to be next moved to, said selecting means including a playing surface, fixed target means on said playing surface comprising a plurality of targets, and variable programming means comprising a plurality of value indicia for each target, a plurality of first indicia on said game board distinguishing each said plurality of locations from each other and a plurality of second indicia on said variable programming means, one for each of said value indicia, each of said plurality of first indicia having a characteristic identical to a characteristic of at least one of said second indicia for relating one of said value indicia of said variable programming means with each target in accordance with the location of said marker.

2. A game as claimed in claim 1 wherein said programming means comprising a plurality of programming devices, one of said plurality of programming devices being adjacent to each of said plurality of targets.

3. A game as claimed in claim 2 wherein each variable programming means comprises a plurality of indicia bearing areas, each area being selectively positionable adjacent the associated target.

4. A game as claimed in claim 1 wherein said playing surface is a putting surface including a pair of boundary lines thereon, said target means being located between said boundary lines, said targets each comprising a hole adapted to receive a golf ball therein.

5. A game as claimed in claim 4, each of said holes having a centerline parallel to said boundary lines, the centerlines of adjacent holes being laterally separated by a distance less than the diameter of said holes.

6. A game as claimed in claim 5, each of said holes having a transverse centerline perpendicular to said boundary lines, said transverse centerline of alternate ones of said holes being coextensive.

7. A game as claimed in claim 6, said transverse centerline of a first group of said holes being spaced from said transverse centerline of a second group of said holes by a distance less than the diameter of said holes.

* * * * *